United States Patent [19]

Theurer et al.

[11] Patent Number: 4,479,439

[45] Date of Patent: Oct. 30, 1984

[54] MOBILE ARRANGEMENT AND METHOD FOR IMPROVING A TRACK BED

[75] Inventors: Josef Theurer, Vienna; Manfred Brunninger, Linz, both of Austria

[73] Assignee: Franz Bahnbaumaschinen-Industriegesellschaft m.b.H, Vienna, Austria

[21] Appl. No.: 438,354

[22] Filed: Nov. 1, 1982

[30] Foreign Application Priority Data

Dec. 22, 1981 [AT] Austria ..... 5525/81

[51] Int. Cl.[3] ..... E01B 27/10

[52] U.S. Cl. ..... 104/7 R; 37/104; 104/2; 104/12; 171/16

[58] Field of Search ..... 104/1 R, 2, 7 R, 12; 171/16; 37/104

[56] References Cited

U.S. PATENT DOCUMENTS

| | | | |
|---|---|---|---|
| 3,872,929 | 3/1975 | Theurer et al. | 171/16 |
| 3,976,142 | 8/1976 | Plasser et al. | 171/16 |
| 4,319,416 | 3/1982 | Scheughzer et al. | 37/104 |
| 4,355,687 | 10/1982 | Theurer et al. | 171/16 |
| 4,357,874 | 11/1982 | Theurer | 104/2 |

*Primary Examiner*—Randolph Reese

*Attorney, Agent, or Firm*—Kurt Kelman

[57] ABSTRACT

A mobile arrangement for continuously laying a sand layer between a subgrade and ballast of a track bed in a construction section of the track comprises a work vehicle supported on undercarriages mounting the vehicle for mobility on the track in an operating direction. The work vehicle comprises a ballast excavating chain including a chain part receiving the excavated ballast. A ballast conveyor conveys ballast to the track section in the operating direction has an output end discharging the conveyed ballast in the track section. A device for planing the sand layer leads the output end in the operating direction, and a sand conveyor conveys sand to the track section in the operating direction. The sand conveyor has an output end discharging the conveyed sand in the track section and laying the sand layer, the output end being positioned between the excavating chain part and the planing device, and the ballast and sand conveyors in their entirety trailing the chain part in the operating direction.

21 Claims, 6 Drawing Figures

MOBILE ARRANGEMENT AND METHOD FOR IMPROVING A TRACK BED

The present invention relates to a mobile arrangement for continuously laying a sand layer between a subgrade and ballast of a track bed in a construction section of the track, and to a method of improving the track bed by providing such a protective layer. The arrangement comprises a work vehicle supported on undercarriages mounting the vehicle for mobility on the track in an operating direction, the track section extending between the undercarriages and the vehicle bridging the track section. In the track bed improving method of this invention, the work vehicle is moved continuously on and along the track in the operating direction, and the ballast layer is removed in the track section while the work vehicle is continuously moved.

U.S. Pat. No. 3,872,929, dated Mar. 25, 1975, discloses a ballast cleaning machine which first deposits a layer of sand on the ballast bed in the cribs, then excavates the ballast and the sand down to the subgrade, conveys the mixture of ballast and sand to a cleaning screen to separate the ballast from the sand, deposits the separated sand in a layer on the exposed subgrade and then deposits the separated ballast on the sand layer so that a protective layer of sand is interposed between the subgrade and the ballast bed. Before the ballast is distributed over the sand layer, the sand is compacted and planed. A sand and ballast conveyor band is linked to the underside of the machine frame above each track rail and is transversely pivotal in a horizontal plane over half the width of the track bed. Each conveyor band has two halves separated by a dividing web for separately conveying the sand and ballast thereon. A guiding device is associated with the output end of the conveyor bands for controlling the different discharge rates of the sand and ballast. While this track bed rehabilitation system has been used with success, the common handling of the ballast and sand may subject the machine to undue stresses and the structural components of the machine must, therefore, be particularly strong to be able to withstand such stresses. Furthermore, humidity may cause the sand to adhere to the ballast so that it cannot be fully separated therefrom on the cleaning screen.

Commonly assigned U.S. patent application Ser. No. 208,191, filed Nov. 19, 1980, now U.S. Pat. No. 4,357,874, discloses a track bed rehabilitation system also designed to lay a protective sand layer between the subgrade and ballast, wherein an assembled track section must first be removed to provide a trackless renewal section. The mobile arrangement herein disclosed comprises two independently moving work vehicles each carrying a conveyor means. This stop-and-go arrangement can be used for the rehabilitation of the track bed only in conjunction with the renewal of the track.

It is the primary object of this invention to provide a mobile track bed rehabilitation arrangement and method of the first-described type which is characterized by the simple and robust construction of the apparatus as well as a particularly efficient and continuously progressing improvement of the track bed.

The above and other objects are accomplished according to one aspect of the invention with a work vehicle comprising a ballast excavating chain including a chain part receiving the excavated ballast and a first conveyor means arranged to receive the excavated ballast from the chain and to convey the excavated ballast. The work vehicle also comprises a second conveyor means for conveying ballast to the track section in the operating direction of the vehicle, the second conveyor means having an output end discharging the conveyed ballast in the track section. A device for planing the sand layer leads the output end in the operating direction, and a third conveyor means conveys sand to the track section in the operating direction. The third conveyor means has an output end discharging the conveyed sand in the track section and laying the sand layer, the output end being positioned between the excavating chain part and the planing device. The second and third conveyor means trail the chain part in the operating direction in their entirety.

According to another aspect of the present invention, the track bed is improved in the method first described hereinabove by separately conveying sand and ballast to the track section in the operating direction, laying the layer of sand on the subgrade and the layer of ballast on the laid layer of sand by distributing the conveyed sand and ballast over the entire width of the track bed by pivoting separate conveyor bands respectively conveying the sand and ballast in this direction, planing the laid layer of sand before the ballast is distributed thereover, and compacting the layer of ballast.

The mobile arrangement of this invention provides a particularly simple and robust structure, the separate conveyor means for the sand and ballast operating simultaneously and continuously to provide a highly efficient non-stop track bed improvement and to handle considerably increased loads. Since the continuously progressing deposition of the sand and ballast layers is effected only in one direction, the total length of the arrangement, including any freight cars required for the transportation of the sand and ballast, is substantially reduced and crossings of the conveyor paths are avoided, thus facilitating maintenance and eliminating trouble spots during operation. The trouble-free functioning of the arrangement in the construction track section is assured by disposing the sand and ballast conveyor means entirely behind the excavating chain part which removes the ballast from this section and having their output ends positioned in the described manner so that there will be no interference between the various operating components. The production of a high-quality track bed is assured by separately depositing the sand and ballast layers, the two layers being sharply separated from each other by interposing the sand planing device between the output end of the one conveyor discharging the sand and the output end of the other conveyor discharging the ballast. In addition, the track bed rehabilitation proceeds rapidly because of the simultaneous and continuous deposition of the sand and ballast layers.

The above and other objects, advantages and features of the invention will become more apparent from the following detailed description of certain now preferred embodiments thereof, taken in conjunction with the accompaying schematic drawing wherein FIG. 1 is a side elevational view of one embodiment of the mobile arrangement including a freight car coupled to the work vehicle;

Figure 1:
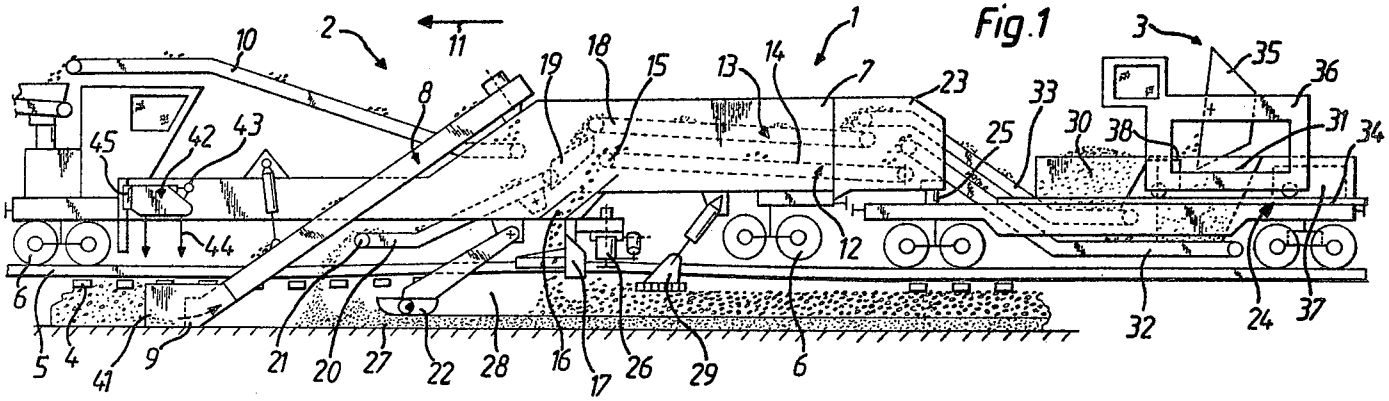
Figure 2:
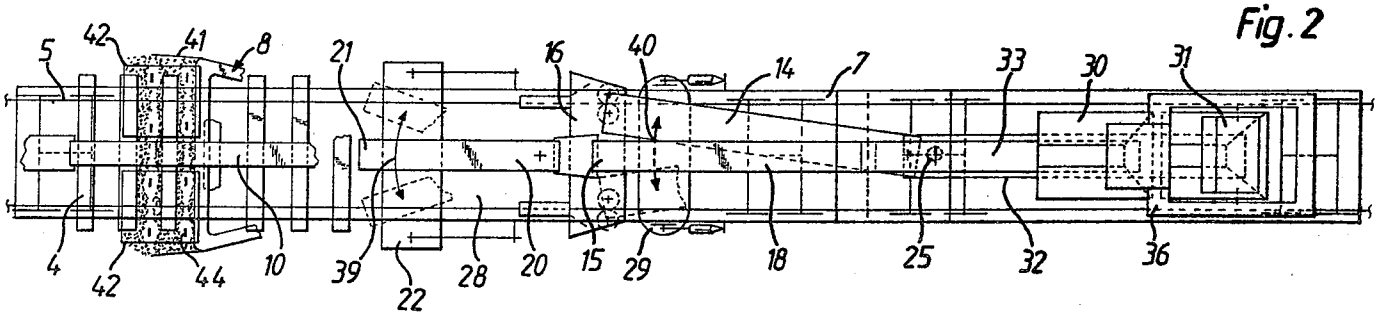
FIG. 2 shows a diagrammatic top view of FIG. 1, showing only the most important structural components thereof.

Referring now to the drawing and first to FIGS. 1 and 2, there is shown mobile arrangement 1 for continuously laying protective sand layer 27 between a subgrade and ballast of a track bed in construction section 28 of the track. The mobile arrangement comprises work vehicle 2 supported on undercarriages 6, 6 mounting the vehicle for mobility on the track consisting of rails 5 fastened to ties 4. The arrangement moves in an operating direction indicated by arrow 11 and track section 28 extends between undercarriages 6. Work vehicle 2 bridges track section 28. In the embodiment of FIGS. 1 and 2, mobile arrangement 1 further comprises freight car 3 coupled to work vehicle 2 to form a train including further freight cars (not shown). The illustrated work vehicle has box-shaped carrier frame 7 extending between the undercarriages and endless ballast excavating chain 8 is vertically adjustably mounted on the carrier frame. The ballast excavating chain includes chain part 9 running below the track and immersed in the ballast for receiving the excavated ballast as the endless chain is moved therethrough. First conveyor means 10 is arranged to receive the excavated ballast from chain 8 and to convey the excavated ballast away from track section 28 in the operating direction indicated by arrow 11.

The work vehicle carries separate conveyor means 12 and 13 for the simultaneous deposition of ballast and sand, which trail chain part 9 in their entirety in the operating direction. Second conveyor means 12 conveys ballast to track section 28 in the operating direction and has output end 15 discharging the conveyed ballast in the track section through chute 16. Third conveyor means 13 conveys sand to track section 28 in the operating direction. Device 22 for planing the sand layer leads output end 16 of the ballast conveyor means in the operating direction. The sand conveyor means has output end 21 discharging the conveyed sand in track section 28 and laying the sand layer, sand conveyor means output end 21 being positioned between excavating chain part 9 and sand planing device 22. In the illustrated embodiment, second and third conveyor means 12 and 13 each includes conveyor 14 and 20, respectively, and the ballast and sand conveyor bands are pivotal laterally over the entire width of the track bed in track section 18. This conveyor structure is relatively inexpensive, compact and space-saving while assuring an even distribution of the ballast and sand.

Ballast plow device 17, which includes a tunnel-shaped part shielding each rail, is arranged in the range of ballast discharge chute 16.

In the illustrated embodiment, sand conveyor means 13 includes another conveyor band 18 trailing pivotal conveyor band 20 in the operating direction, conveyor band 18 being arranged above conveyor band 14. Conveyor band 18 is shown centrally positioned within carrier frame 7 and chute 19 leads from conveyor band 18 to conveyor band 20 of the sand conveyor means. This preferred conveyor means arrangement assures a trouble-free simultaneous operation of the ballast and sand conveyors. The provision of additional conveyor band 18 makes it possible simply to adapt the arrangement to different sand requirements just by changing the forward speed of conveyor band 18 while the connection of conveyor band 18 to pivotal conveyor band 20 by chute 19 always assures a trouble-free conveyance of the sand.

In the embodiment of FIGS. 1 and 2, a plurality of freight cars are coupled to, and trail, work vehicle 2 in the operating direction, the work vehicle and freight cars forming a train. The freight cars have substantially coplanar platforms 24 capable of supporting containers 35 filled with ballast and sand. A continuous track 34 on the platforms supports and guides mobile gantry crane 36 for movement along the platforms. As shown in the drawing, work vehicle carrier frame 7 has rear end 23 in the operating direction and first freight car 3 has a front end in the operating direction coupled to the rear end of the carrier frame. The carrier frame rear end overhangs the platform of freight car 3 at the front end, which is supported by an undercarriage running on the track. Lifting mechanism 25, preferably a hydraulic jack, connects carrier frame rear end 23 and the freight car front end. Thus, rear undercarriage 6 of work vehicle 2 may be lifted off the track (as shown in FIG. 1), thus effectively increasing the length of the construction section. Such a work train is capable of efficiently storing required amounts of ballast and sand while enabling desired amounts thereof to be delivered to the construction section in the operating direction. Any number of freight cars may be interconnected by the crane track for the required transport of the track bed materials. Coupling freight car 3 to work vehicle 2 by a lifting jack simply and effectively adapts the mobile arrangement for movement from one working site to another and for operation at the working site. During movement from site to site, rear undercarriage 6 of work vehicle 2 is lowered onto the track so that the vehicle runs securely on the track while the operating range of the vehicle is substantially lengthened at the working site simply by lifting the undercarriage off the track and thus effectively supporting the rear end of vehicle carrier frame 7 on the front undercarriage of freight car 3.

Work vehicle 2 further comprises track lifting and holding device 26 trailing sand planing device 22 in the operating direction and mounted on the vehicle carrier frame preferably immediately trailing ballast plow device 17. As is entirely conventional, device 26 power-actuated, laterally pivotal flanged rollers engaging the rails for lifting and holding them at a desired level. Device 22 for compacting and planing sand layer 27 preferably comprises a crank drive for vibrating the sand layer contacting plate of the planing device, the plate being linked to carrier frame 7 for vertically adjustable positioning below the track. Work vehicle 2 also comprises vertically adjustable ballast planing device 29 trailing track lifting and holding device 26 in the operating direction, the illustrated ballast planing device comprising an endless chain moving in a horizontal plane over the ballast continuously deposited on planed sand layer 27 through chute 16. A hydraulic drive preferably mounts ballast planing device 29 for vertical adjustment on carrier frame 7 and this device, too, is preferably laterally pivotal.

As shown in FIGS. 1 and 2, respective storage receptacles 31 and 30 for storing ballast and sand, respectively, are arranged on freight car 3, ballast conveyor means 12 and sand conveyor means 13 having respective input ends trailing output ends 15 and 21 in the operating direction. The input ends of the respective conveyor means are respectively positioned below respective storage receptacles 31 and 30. This arrangement of the storage receptacles and associated conveyor means assures a trouble-free operation and a high working speed obtained by the continuous supply of sand and ballast to traction section 28.

In the illustrated embodiment, ballast conveyor means 12 comprises endless ballast conveyor band 32 trailing pivotal ballast conveyor band 14 in the operating direction and extending with its rear end below ballast storage receptacle 31 to receive the ballast therefrom and to convey the ballast to output chute 16. Sand conveyor means 13 comprises endless sand conveyor band 33 trailing sand conveyor band 18 in the operating direction and extending with its rear end below sand storage receptacle 30 to receive the sand therefrom and to convey the sand to output end 21. Conveyor band 33 is positioned above conveyor band 32.

The freight cars coupled to work vehicle 2 carry containers 35 filled with sand and ballast. Gantry crane 36 is propelled by drive 37 along track 34 on coplanar platforms 24 of the freight cars to move the stored containers to the illustrated loading station on freight car 3 for respectively filling storage receptacles 30 and 31 with sand and ballast. Freight car 3 has its own drive 38 to enable it to be self-propelled when it is uncoupled from work vehicle 2 by disassembling hydraulic lift 25.

As shown in FIG. 2, sand conveyor band 20 is pivotal in the directions of double-headed arrow 39 over the width of the track bed for even distribution of the sand while the even distribution of the ballast is assured by the similar pivoting of wider conveyor band 14 in the directions of double-headed arrow 40. To enable the ballast to be distributed also over the track bed shoulders, output chute 16 has lateral portions projecting beyond the width of carrier frame 7 and beyond the ends of track ties 4. Ballast excavating chain 8 has laterally arranged, vertical baffles 41 in the range of chain part 9 to prevent a lateral displacement of the ballast.

In the illustrated embodiment, work vehicle 2 furthermore comprises device 42 for loosening the ballast, a respective ballast loosening device 42 being associated with each rail 5 and leading chain part 9 in the operating direction, and drive means 45 for vertically adjusting the ballast loosening device. The illustrated ballast loosening device comprises vibratory ballast loosening tools 44 which are similar to ballast tamping tools and are arranged for immersion in the cribs of the track bed along the longitudinal edges of ties 4 and at the points of intersection between the ties and rails. This arrangement makes it possible readily to excavate even hard and encrusted ballast beds since the ballast will be broken apart and loosened in layers by the immersed vibratory tools, and ballast excavating chain part 9 will receive the loosened ballast. In this manner, the ballast excavation will be greatly facilitated while removing undue stress from the excavating chain, and the arrangement may be operated substantially with the same efficiency and speed under varying ballast bed conditions.

Figure 3:
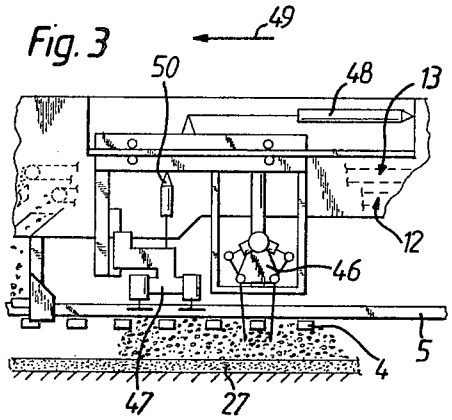
FIG. 3 shows a partial side elevational view of a modification of the arrangement of FIG. 1, wherein the ballast planing device has been replaced by a ballast tamping unit.
Figure 5:
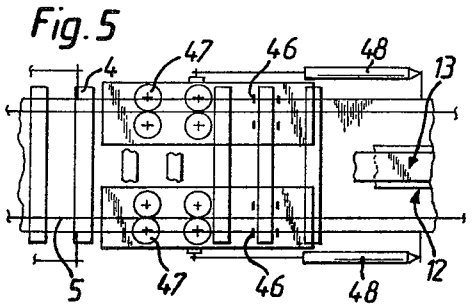

FIGS. 3 and 5 illustrate another embodiment of the mobile arrangement of this invention, wherein the work vehicle further comprises vertically adjustable ballast tamping unit 46 arranged immediately adjacent and trailing track lifting and holding device 47 which is vertically adjustable by hydraulic drive 50. Hydraulic drive 48 connects the tamping unit to the carrier frame of the work vehicle so that the tamping unit is displaceable in the operating direction indicated by arrow 49. The generally conventional tamping unit has pairs of vibratory tamping tools immersible in the track bed cribs for tamping ballast under ties 4. Device 47 enables the track to be held at the desired level during the track bed rehabilitation operation or to be lifted to a higher level, if desired, at which level the ballast is tamped for fixing the track in position. As shown in FIG. 5, a respective tamping unit 46 is associated with each rail 5, together with a respective track lifting and holding device 47, the arrangement enabling individual ties to be tamped independently, regardless of whether or not the ties are in parallel position. This arrangement enables the newly laid ballast bed to be immediately compacted in a preliminary manner during the track bed rehabilitation work so that the succeeding freight cars run more smoothly over the track and the forward speed of the mobile arrangement may be correspondingly increased.

Figure 4:
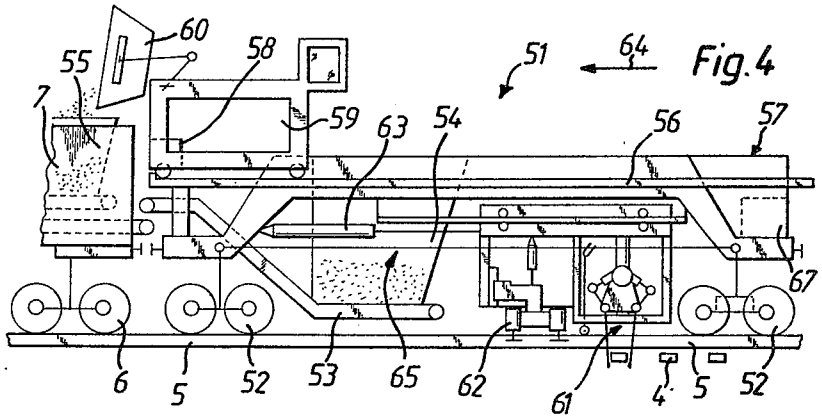
FIG. 4 is a partial side elevation of another embodiment of the mobile arrangement, wherein a mobile track leveling and tamping machine is coupled to the work vehicle.
Figure 6:
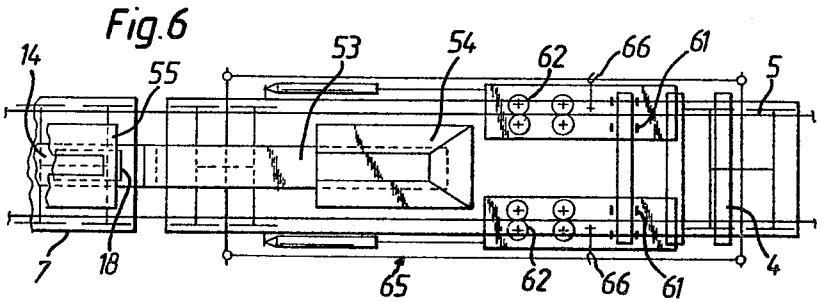
FIGS. 5 and 6 are, respectively, diagrammatic top views of FIGS. 3 and 4.

In the embodiment of FIGS. 4 and 6, first freight car 51 coupled to, and trailing, frame 7 of the work vehicle is constituted by a track leveling and tamping machine. The machine has a frame supported on two undercarriages 52, 52 for mobility on the track. In this embodiment, carrier frame 7 has no rearwardly projecting part overhanging platform 57 of freight car 51 but rear undercarriage 6 of the work vehicle supports the vehicle on the track adjacent to front undercarriage 52 of car 51. The ballast conveyor means of this embodiment comprises endless conveyor band 53 whose rear end extends below the discharge opening of ballast storage receptacle 54 while its front end extends forwardly of front undercarriage 52 and leads to conveyor band 14 of the ballast conveyor means. Sand storage receptacle 55 is arranged at the rear end of carrier frame 7 of the work vehicle. Platform 57, which is coplanar with the platforms of succeeding freight cars (not shown), carries track 56 over which gantry crane 59 is moved by drive 58 for the transport of containers 60 filled with ballast or sand.

Similarly to the embodiment of FIG. 3, freight car 51 carries vertically adjustable and longitudinally displaceable tamping unit 61 and track lifting device 62 forming an assembly with the associated tamping unit for longitudinal displacement therewith by hydraulic drive 63. Leveling reference system 65 controls track lifting device 62, a sending element 66 cooperating with the reference system in the range of the lifting device and tamping unit. This leveling and tamping machine is self-propelled by means of drive 67 operated for moving the machine independently and when it is not coupled to the work vehicle, thus making freight car 51 useful as an independent track leveling and tamping machine. With this arrangement, the track may be leveled and tamped before the succeeding freight cars, which carry heavy loads, run thereover, thus making certain that these heavily loaded cars ride smoothly and thereby making it possible to operate the mobile arrangement at a higher speed. Such leveling will also enhance the general operational safety.

The method of improving a track bed according to this invention will be generally apparent from the above description of a mobile arrangement for continuously laying a sand layer between a subgrade and ballast of a track bed in a construction section of the track, and will be further elucidated hereinafter by reference to the arrangement of FIGS. 1 and 2.

After the work vehicle has been moved to track section 28 so that carrier frame 7 bridges this track section, ballast excavating chain 8 is positioned in a well known manner so that chain part 9 runs transversely under the track. At the same time, hydraulic jack 25 is operated to lift rear undercarriage 6 of vehicle 2 off the track, rear end 23 of vehicle carrier frame 7 being supported on the front end of the platform of trailing freight car 3. The flanged rail engaging rollers of track lifting and holding device 26 are now operated to lift track rails 5 somewhat off the underlying ballast. The work vehicle is then continuously moved on and along the track in the operating direction indicated by arrow 11 while the track rail engaging rollers remain engaged so that the track remains at the desired level during the entire track bed rehabilitation operation. While work vehicle 2 is continuously moved, the ballast layer in track section 28 is removed by the continuous movement of endless ballast excavating chain 8 in a manner well known per se, and the excavated ballast is removed by conveyor means 10 to be loaded into cars in front of mobile arrangement 1. Sand and ballast are separately conveyed to track section 28 in the operating direction, layer of sand 27 being laid on the exposed subgrade and a layer of ballast being laid on the laid layer of sand by distributing the conveyed sand and ballast over the width of the track bed by pivoting conveyor bands 20 and 14 respectively conveying the sand and ballast in the direction of arrow 11. Planing of the evenly distributed sand layer 27 before the ballast is distributed thereover assures the production of a protective layer of uniform thickness interposed between the subgrade and the ballast. Subsequently, the ballast is planed by horizontally moving endless planing chain 29. The ballast is evenly discharged from storage receptacle 31 on conveyor band 32 in dependence on the speed of the conveyor bands constituting ballast conveyor means 12. The ballast is discharged at output end 16 through chute 16 and the constant pivoting of conveyor band 14 during the forward movement of the work vehicle at a relatively constant speed assures the even distribution of the ballast over the width of the track bed on top of planed sand layer 27. The ballast layer is compacted by planing device 26 or, in the embodiments of FIGS. 3 and 4, it may be compacted by tamping the ballast under ties 4. In this manner, the track already rests on the rehabilitated track bed in the range of the front undercarriage of first freight car 3 (or 51), thus assuring a smooth ride for the entire work train. Particularly if the ballast is heavily encrusted, tools 44 are operated to loosen the ballast in track section 28 before it is removed by excavating chain 8. With this method, a track bed is completely rehabilitated at a high operating speed not only by removing the old, usually dirty ballast and replacing it with clean ballast but also by simultaneously providing a protective sand layer over the subgrade in a single, continuous operation. The great efficiency of this method makes it possible to rehabilitate track beds during relatively short intervals between trains, such rehabilitation work previously requiring the track to be closed entirely to train traffic.

In the embodiments of FIGS. 3 and 4, the continuous forward movement of the mobile arrangement is assured by the longitudinal displacement of the track lifting device-tamping unit assembly during ballast tamping in synchronism with the forward speed of the work vehicle so that the tamping tools will remain in position over each tie to be tamped for a sufficient period of time to make adequate ballast tamping under the tie possible. After each tie tamping has been completed and the tamping unit is raised to lift the tamping tools out of the ballast, the track lifting device-tamping unit assembly is advanced into a forward position so that the tamping tools are properly positioned for the next succeeding tamping operation.

In the embodiment of FIG. 4, the track is leveled under the control of reference system 65 before the ballast is tamped.

If desired, the embodiment of FIG. 1 may be modified in the manner shown in FIG. 3 and, additionally, the leveling and tamping machine of FIG. 4 may also be used in conjunction therewith.

While the present invention has been described and illustrated in connection with certain now preferred embodiments, many variations may occur to those skilled in the art without departing from the spirit and scope thereof, as defined in the appended claims. More particularly, for example, the protective layer between the subgrade and ballast may consist not only of sand but also of bitumen, asphalt or the like alone, or mixed with sand. Such equivalent protective materials are, therefore, understood to be encompassed by the term "sand" through the specification and claims. Various combinations of the illustrated embodiments may be used in dependence on the track conditions. For instance, freight car 3 coupled to work vehicle 2 may be replaced by self-propelled freight car 51, as shown in FIG. 5, or such a self-propelled leveling and tamping machine may be combined with a work vehicle which has a projecting rear frame portion 23 supported by a rear undercarriage 6.

What is claimed is:

1. A mobile arrangement for continuously laying a sand layer between a subgrade and ballast of a track bed in a construction section of the track, which comprises a work vehicle supported on undercarriages mounting the vehicle for mobility on the track in an operating direction, the track section extending between the undercarriages and the vehicle bridging the track section, the work vehicle comprising (a) ballast excavating chain including
  (1) a chain part receiving the excavated ballast,
(b) a first conveyor means arranged to receive the excavated ballast from the chain and to convey the excavated ballast,
(c) a second conveyor means for conveying ballast to the track section in the operating direction, the second conveyor means having
  (1) an output end discharging the conveyed ballast in the track section,
(d) a device for planing the sand layer, the planing device leading said output end in the operating direction, and
(2) a third conveyor means for conveying sand to the track section in the operating direction, the third conveyor means having
  (1) an output end discharging the conveyed sand in the track section and laying the sand layer, said output end being positioned between the excavating chain part and the planing device, and
  (2) the second and third conveyor means in their entirety trailing the chain part in the operating direction.

2. The mobile arrangement of claim 1, wherein the second and third conveyor means each includes a conveyor band pivotal laterally over the width of the track bed in the track section.

3. The mobile arrangement of claim 1, wherein the vehicle has a box-shaped carrier frame and the conveyor bands are pivotally mounted within the carrier frame.

4. The mobile arrangement of claim 3, wherein the third conveyor means includes another conveyor band trailing the pivotal conveyor band in the operating direction, the other conveyor band being arranged above the second conveyor means.

5. The mobile arrangement of claim 4, wherein the other conveyor band is centrally positioned within the carrier frame.

6. The mobile arrangement of claim 1, further comprising respective storage receptacles for storing ballast and sand, respectively, the second and third conveyor means having respective input ends trailing the output ends in the operating direction, the input ends being respectively positioned below the respective storage receptacles.

7. The mobile arrangement of claim 6, further comprising a freight car coupled to the work vehicle, the storage receptacles and input ends of the second and third conveyor means being arranged on the freight car.

8. The mobile arrangement of claim 6, wherein the work vehicle has a frame with a rear end in the operating direction, further comprising a freight car with a front end coupled to the work vehicle frame rear end, the storage receptacle for the sand being arranged in the range of the rear end of the work vehicle and the storage receptacle for the ballast being arranged in the range of the front end of the freight car.

9. The mobile arrangement of claim 1, further comprising a plurality of freight cars coupled to, and trailing, the work vehicle in the operating direction, the work vehicle and freight cars forming a train, the freight cars having substantially coplanar platforms capable of supporting containers filled with ballast and sand, and a continuous track on the platforms for supporting and guiding a mobile crane for movement along the platforms.

10. The mobile arrangement of claim 9, wherein the work vehicle includes a carrier frame having a rear end in the operating direction, a first one of the freight cars having a front end in the operating direction coupled to the rear end of the carrier frame and the carrier frame rear end overhanging the front end of the first freight car, and further comprising a lifting mechanism connecting the carrier frame rear end and the freight car front end.

11. The mobile arrangement of claim 1, further comprising a track lifting and holding device trailing the sand planing device in the operating direction.

12. The mobile arrangement of claim 11, further comprising a vertically adjustable ballast planing device trailing the track lifting and holding device in the operating direction.

13. The mobile arrangement of claim 12, wherein the ballast planing device comprises an endless chain.

14. The mobile arrangement of claim 11, further comprising a vertically adjustable ballast tamping unit arranged immediately adjacent and trailing the track lifting and holding device in the operating direction, the tamping unit being displaceable in said direction.

15. The mobile arrangement of claim 1, further comprising a track leveling and tamping machine trailing the work vehicle in the operating direction, the machine having a frame supported on two undercarriages for mobility on the track, a track lifting device, a leveling reference system controlling the track lifting device and a tamping unit trailing the lifting device in the operating direction and displaceable in said direction, the track lifting device and tamping unit being mounted on the machine frame between the undercarriages.

16. The mobile arrangement of claim 1, further comprising a device for loosening the ballast, the ballast loosening device leading the chain part in the operating direction, and drive means for vertically adjusting the ballast loosening device.

17. The mobile arrangement of claim 16, wherein the ballast loosening device comprises vibratory ballast loosening tools arranged for immersion in the cribs of the track bed.

18. A method of improving a track bed comprising a layer of ballast disposed on a subgrade by laying a protective layer of sand between the subgrade and the ballast in a construction section of the track, which comprises the following steps:

(a) continuously moving a work vehicle bridging the track section on and along the track in an operating direction, (b) removing the ballast layer in the track section while the work vehicle is continuously moved, (c) separately conveying sand and ballast to the track section in the operating direction, (d) laying the layer of sand on the subgrade and the layer of ballast on the laid layer of sand by distributing the conveyed sand and ballast over the entire width of the track bed by pivoting separate conveyor bands respectively conveying the sand and ballast in said direction, (e) planing the laid layer of sand before the ballast is distributed thereover, and (f) compacting the layer of ballast.

19. The method of claim 18, further comprising the step of loosening the ballast in said track section before it is removed.

20. The method of claim 18, wherein the layer of ballast is compacted by planing.

21. The method of claim 18, the track being comprised of rails fastened to ties, wherein the layer of ballast is compacted by tamping the ballast under the ties.

* * * * *

UNITED STATES PATENT AND TRADEMARK OFFICE

CERTIFICATE OF CORRECTION

PATENT NO. : 4,479,439

DATED : OCTOBER 30, 1984

INVENTOR(S) : THEURER ET AL

It is certified that error appears in the above—identified patent and that said Letters Patent is hereby corrected as shown below:

Cover page, [73] , Assignee's name should read --Franz Plasser Bahnbaumaschinen-Industriegesellschaft m.b.H.--

Signed and Sealed this

*Twenty-third* Day of *July 1985*

[SEAL]

*Attest:*

DONALD J. QUIGG

*Attesting Officer* *Acting Commissioner of Patents and Trademarks*